US010431157B2

(12) United States Patent
Cai

(10) Patent No.: US 10,431,157 B2
(45) Date of Patent: Oct. 1, 2019

(54) OLED DISPLAY DEVICE AND PIXEL DRIVING CIRCUIT THEREOF

(71) Applicant: Shenzhen China Star Optoelectronics Semiconductor Display Technology Co., Ltd., Shenzhen, Guangdong (CN)

(72) Inventor: Yuying Cai, Guangdong (CN)

(73) Assignee: Shenzhen China Star Optoelectronics Semiconductor Display Technology Co., Ltd, Shenzhen, Guangdong (CN)

( * ) Notice: Subject to any disclaimer, the term of this patent is extended or adjusted under 35 U.S.C. 154(b) by 22 days.

(21) Appl. No.: 15/766,865

(22) PCT Filed: Sep. 14, 2017

(86) PCT No.: PCT/CN2017/101767

§ 371 (c)(1),
(2) Date: Apr. 9, 2018

(87) PCT Pub. No.: WO2019/033487

PCT Pub. Date: Feb. 21, 2019

(65) Prior Publication Data

US 2019/0074340 A1 Mar. 7, 2019

(30) Foreign Application Priority Data

Aug. 18, 2017 (CN) ..... 2017 1 0709604

(51) Int. Cl.

| | |
|---|---|
| ***G09G 3/3233*** | (2016.01) |
| ***G09G 3/3266*** | (2016.01) |
| ***G09G 3/3275*** | (2016.01) |

(52) U.S. Cl.
CPC ..... *G09G 3/3233* (2013.01); *G09G 3/3266* (2013.01); *G09G 3/3275* (2013.01);
(Continued)

(58) Field of Classification Search
CPC .. G09G 3/3233; G09G 3/3266; G09G 3/3275; G09G 2320/045;
(Continued)

(56) References Cited

U.S. PATENT DOCUMENTS

2005/0052377 A1* 3/2005 Hsueh ..... G09G 3/3233 345/82
2011/0102418 A1 5/2011 Park
(Continued)

FOREIGN PATENT DOCUMENTS

CN 101488319 A 7/2009
CN 102074189 A 5/2011
(Continued)

*Primary Examiner* — Jonathan A Boyd
(74) *Attorney, Agent, or Firm* — Andrew C. Cheng

(57) ABSTRACT

A pixel driving circuit using 4T2C pixel structure applied in an OLED display device is provided. The OLED display device senses a threshold voltage imposed on the TFT and a turn-on voltage imposed on the OLED when the OLED display device is powered off or powered on and compensates the threshold voltage which is sensed in normal operating display and the turn-on voltage imposed on the OLED for raw data signals, thereby reducing the influence of the threshold voltage imposed on the TFT on the turn-on voltage of the OLED and improving the display quality of the OLED display device.

11 Claims, 12 Drawing Sheets

(52) U.S. Cl.
CPC ..... *G09G 2300/0819* (2013.01); *G09G 2300/0852* (2013.01); *G09G 2300/0861* (2013.01); *G09G 2320/0233* (2013.01); *G09G 2320/0295* (2013.01); *G09G 2320/045* (2013.01)

(58) Field of Classification Search
CPC ... G09G 2320/0295; G09G 2320/0233; G09G 2300/0852; G09G 2300/0819; G09G 2300/0861
See application file for complete search history.

(56) References Cited

U.S. PATENT DOCUMENTS

2013/0106828 A1* 5/2013 Kim ..... G09G 3/3233 345/212
2015/0220201 A1* 8/2015 Wu ..... G06F 3/0412 345/173

FOREIGN PATENT DOCUMENTS

CN 102138172 A 7/2011
CN 103165078 A 6/2013
CN 105761678 A 7/2016

* cited by examiner

OLED DISPLAY DEVICE AND PIXEL DRIVING CIRCUIT THEREOF

BACKGROUND

1. Field of the Disclosure

The present disclosure relates to the field of display technology, and more particularly, to a pixel driving circuit for an organic light-emitting diode (OLED) display device and the OLED display device with the pixel driving circuit.

2. Description of the Related Art

Recently, an organic light-emitting diode (OLED) display device has been a very popular and new flat display product worldwide because the OLED display device has features of auto-luminescence, wide viewing angles, short response time, high luminous efficacy, wide color gamut, low operating voltage, small thickness, potential to produce a display device with large sizes and flexibility, and simple manufacturing process. Besides, the OLED display device costs less to a larger extent.

The TFT with a capacitor storage signal controls the brightness and grayscale of the OLED in the OLED display device. To achieve the goal of the constant current driving, each of the pixels needs to be formed by two or more TFTs and a storage capacitor, that is, a 2T1C mode. FIG. 1 is a circuit diagram of a pixel driving circuit arranged in an OLED display device of related art. As FIG. 1 illustrates, the pixel driving circuit of the OLED display device of related art includes two TFTs and a capacitor. Specifically, the pixel driving circuit includes a switching TFT T1, a driving TFT T2, and a storing capacitor Cst. The driving current flowing through the OLED is controlled by the driving TFT T2. The current measures $I_{OLED}=k(V_{gs}-V_{th})^2$ where k indicates an intrinsic conducting factor of the driving TFT T2 and determined by the characteristics of the driving TFT T2; $V_{th}$ indicates a threshold voltage of the driving TFT T2; $V_{gs}$ indicates the voltage imposed on a gate and a source of the driving TFT T2. The threshold voltage $V_{th}$ of the driving TFT T2 drifts in the long-time operation so the driving current flowing through the OLED changes, thereby causing poor display of the OLED display device and affecting the quality of display images.

SUMMARY

To solve the technology of the related art, an object of the present disclosure is to propose a pixel driving circuit and an organic light-emitting diode (OLED) display device with the pixel driving circuit. The pixel driving circuit is arranged in the OLED display device and can diminish the threshold voltage imposed on a thin-film transistor (TFT) which affects the driving current flowing through the OLED.

According to a first aspect of the present disclosure, a pixel driving circuit for an organic light-emitting diode (OLED) display device includes a first thin-film transistor (TFT), a second TFT, a third TFT, a fourth TFT, a first capacitor, a second capacitor and an OLED. The first TFT includes a gate electrically connected to a first node, a source electrically connected to a second node, and a drain electrically connected to a first supply voltage. The second TFT includes a gate receiving a second scanning signal and a drain electrically connected to the first node. The third TFT includes a gate receiving a first scanning signal and a source electrically connected to the second node. The fourth TFT includes a gate receiving a third scanning signal and a drain electrically connected to the second node. The first capacitor is electrically connected between the first node and the second node. The second capacitor iselectrically connected between the second node and a reference signal at low voltage level. The OLED includes an anode electrically connected to a drain of the third TFT and a cathode electrically connected to a second supply voltage. When the OLED display device is powered off or powered on, a source of the second TFT receiving the first data signal; a source of the fourth TFT receives an initialized signal or a voltage sensor, the voltage sensor is configured to sense a threshold voltage of the first TFT and a turn-on voltage of the OLED and generate a threshold voltage signal and a turn-on voltage compensating signal. When the OLED display device operates normally, the source of the second TFT receives the second data signal formed by a combination of the threshold voltage signal, the turn-on voltage compensating signal, and a raw data signal. The initialized signal and the first data signal are both at constantly low voltage level; the raw data signal is at single-pulse high voltage level.

Furthermore, the pixel driving circuit performs a reset operation, a threshold voltage sensing operation, and a turn-on voltage sensing operation when the OLED display device is powered off or powered on.

Furthermore, when the pixel circuit performs the reset operation, the first scanning signal is at low voltage level, the second scanning signal and the third scanning signal are both at high voltage level, the source of the fourth TFT receives the initialized signal.

Furthermore, when the pixel circuit performs the threshold voltage sensing operation, the first scanning signal is at low voltage level, the second scanning signal and the third scanning signal are both at high voltage level, the source of the fourth TFT receives the voltage sensor.

Furthermore, the pixel circuit performs the turn-on voltage sensing operation, the first scanning signal and the third scanning signal are both are high voltage level, the second scanning signal is at low voltage level; the source of the fourth TFT receives the voltage sensor.

Furthermore, the pixel driving circuit performs the reset operation, a threshold voltage sensing operation, a threshold voltage compensating operation, and a driving operation when the OLED display device is in normal display.

Furthermore, when the pixel circuit performs the reset operation, the first scanning signal and the second scanning signal are at high voltage level, the third scanning signal is at high voltage level, and the second data signal is a sum of the reference signal at low voltage level, the threshold voltage signal and the turn-on voltage compensating signal.

Furthermore, when the pixel circuit performs the threshold voltage sensing operation, the first scanning signal and the third scanning signal are at low voltage level, the second scanning signal is at high voltage level, and the second data signal is a sum of the reference signal at low voltage level, the threshold voltage signal and the turn-on voltage compensating signal.

Furthermore, when the pixel circuit performs the threshold voltage compensating operation, the first scanning signal and the third scanning signal are both are low voltage level, the second scanning signal is at high voltage level, and the second data signal is a sum of the reference signal at high voltage level, the threshold voltage signal and the turn-on voltage compensating signal.

Furthermore, the pixel driving circuit performs the driving operation, the first scanning signal is at high voltage level, the second scanning signal and third scanning voltage are at high voltage level, and the second data signal is the sum of the reference signal at low voltage level, the threshold voltage signal and the turn-on voltage compensating signal.

In a second aspect of the present disclosure, an organic light-emitting diode (OLED) display device comprising the pixel driving circuit as provided above.

The present disclosure has beneficiary effects as follows. The OLED display device senses a threshold voltage imposed on the TFT and a turn-on voltage imposed on the OLED when the OLED display device is powered off or powered on and compensates the threshold voltage which is sensed in normal operating display and the turn-on voltage imposed on the OLED for raw data signals, thereby reducing the influence of the threshold voltage imposed on the TFT on the turn-on voltage of the OLED and improving the display quality of the OLED display device.

BRIEF DESCRIPTION OF THE DRAWINGS

The invention is described below in detail with reference to the accompanying drawings, wherein like reference numerals are used to identify like elements illustrated in one or more of the figures thereof, and in which exemplary embodiments of the invention are shown.

DETAILED DESCRIPTION OF THE EMBODIMENTS

Figure 1:
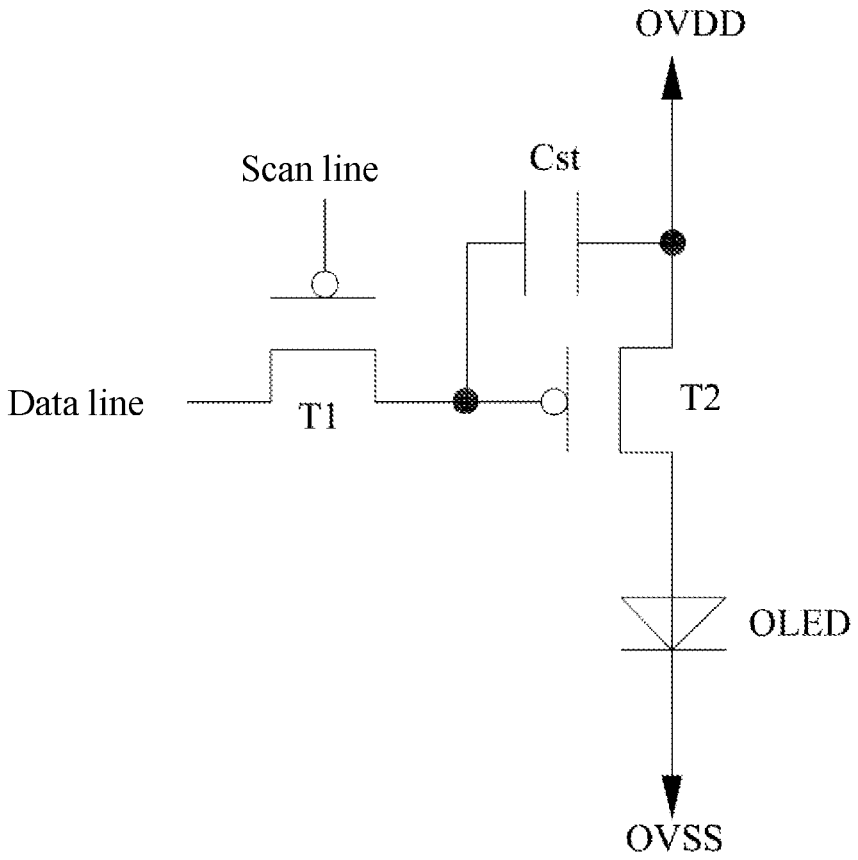
Fig. 1 (Related art)
FIG. 1 is a circuit diagram of a pixel driving circuit arranged in an OLED display device of related art.

Embodiments of the present application are illustrated in detail in the accompanying drawings, in which like or similar reference numerals refer to like or similar elements or elements having the same or similar functions throughout the specification. The embodiments described below with reference to the accompanying drawings are exemplary and are intended to be illustrative of the present application, and are not to be construed as limiting the scope of the present application.

In the drawings, thickness of layers and areas is exaggerated for clarify. In addition, same element illustrated in drawings is tabled as the same number.

Figure 2:
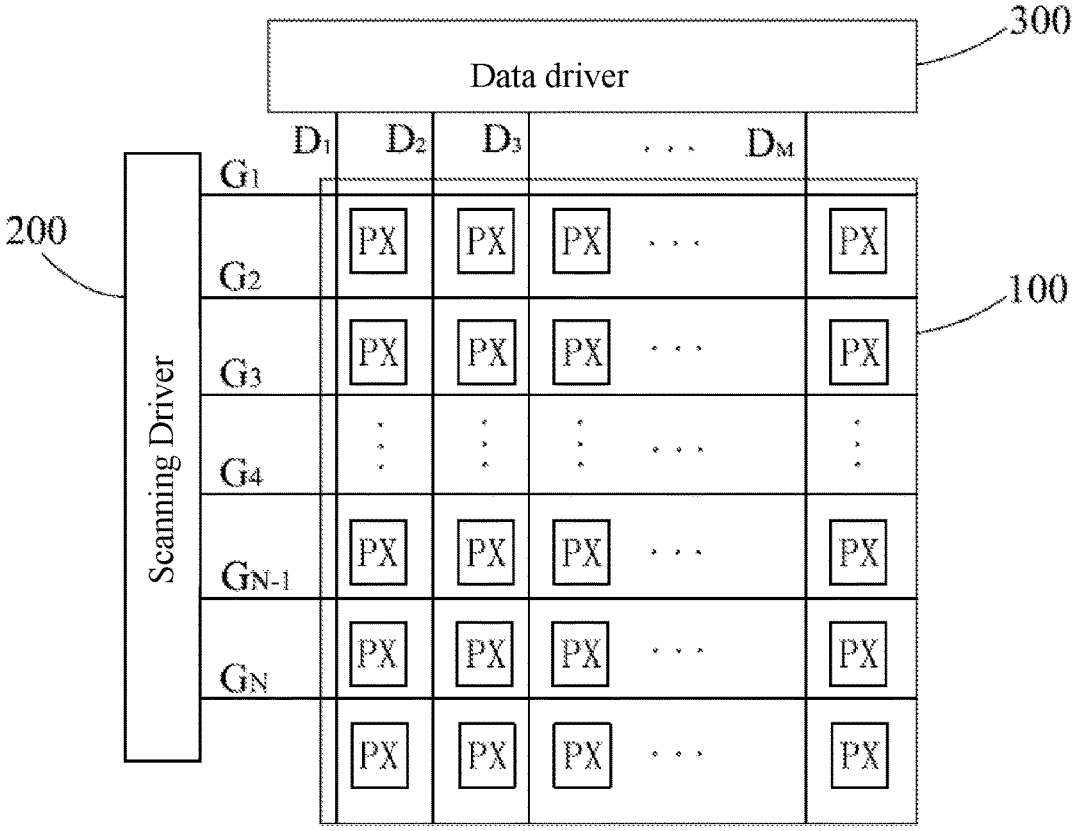
FIG. 2 illustrates a schematic diagram of an organic light-emitting diode (OLED) display device according to a first embodiment of the present disclosure.

Please refer to FIG. 2 illustrating a schematic diagram of an organic light-emitting diode (OLED) display device according to a first embodiment of the present disclosure.

Please refer to FIG. 2. The OLED display device includes a display panel 100, a scanning driver 200, and a data driver 300. The OLED display device further includes other proper devices such as a timing controller which controls the scanning driver 200 and the data driver 300, a power voltage generator which supplies power positive electrode voltage and power negative electrode voltage, etc.

Specifically, the display panel 100 includes a plurality of pixels PX arranged in an array, N scanning lines $G_1$ to $G_N$, and M data lines $D_1$ to $D_M$. The scanning driver 200 is connected to the scanning lines $G_1$ to $G_N$ and drives the scanning lines $G_1$ to $G_N$. The data driver 300 connected to the data lines $D_1$ to $D_M$ drives the data lines $D_1$ to $D_M$.

Each of the plurality of pixels PX may be supplied with a scanning signal or a plurality of scanning signals by the scanning driver 200. Each of the plurality of pixels PX may be supplied with a data signal by the data driver 300. Both of them will be detailed later.

Each of the pixels PX includes a pixel driving circuit. The pixel driving circuit proposed by the present disclosure is detailed as follows.

Figure 3:
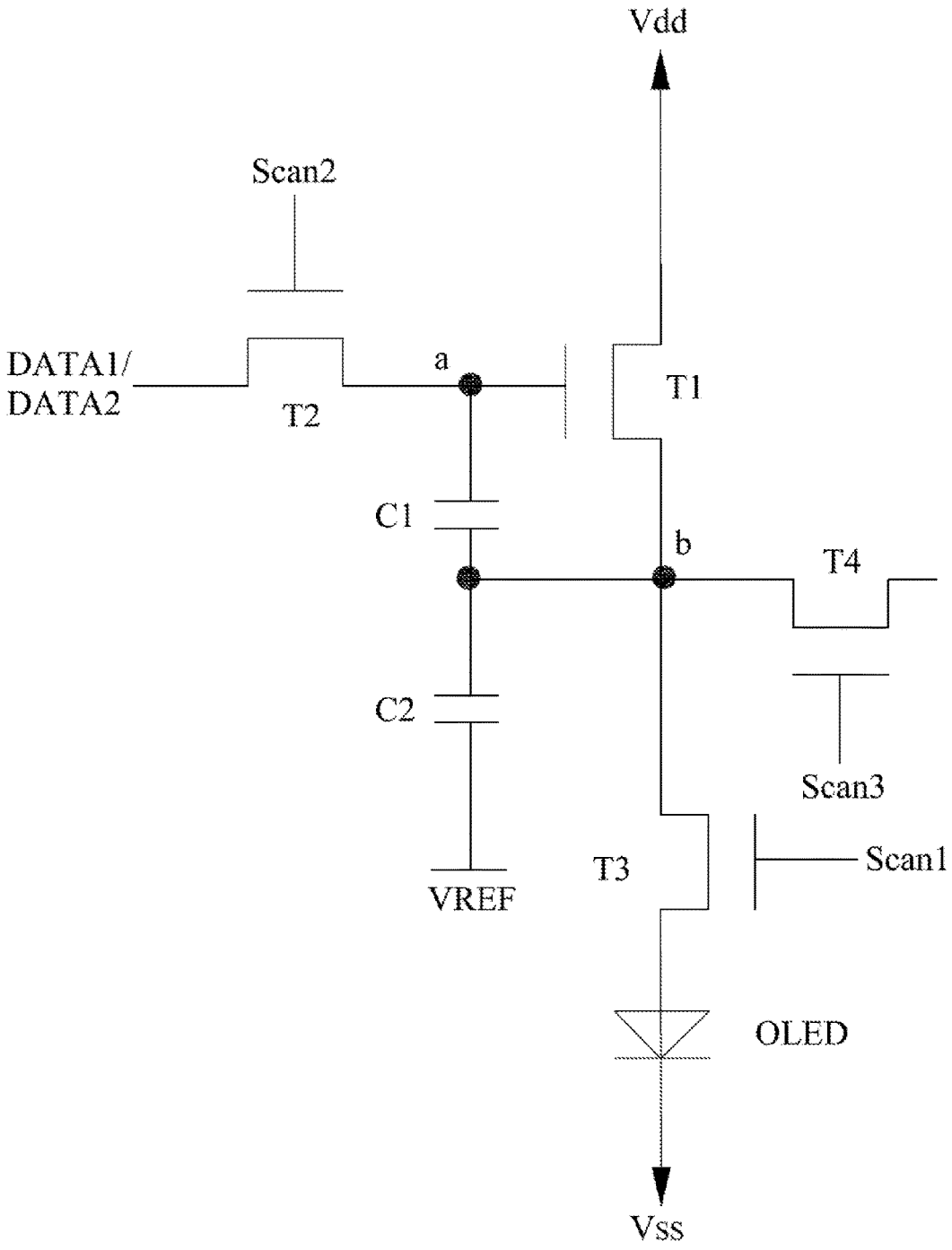
FIG. 3 illustrates an equivalence circuit diagram of the pixel structure of the OLED display device according to the first embodiment of the present disclosure.

Please refer to FIG. 3 illustrating an equivalence circuit diagram of the pixel structure of the OLED display device according to the first embodiment of the present disclosure.

Please refer to FIG. 3. The structure of each of the pixels PX is a 4T2C pixel. The 4T2C pixel includes an OLED, a first thin-film transistor (TFT) T1, a second TFT T2, a third TFT T3, a fourth TFT T4, a first capacitor C1, and a second capacitor C2.

A gate of the first TFT T1 is electrically connected to a first node a. A source of the first TFT T1 is electrically connected to a second node b. A drain of the first TFT T1 is electrically connected to a first supply voltage Vdd.

A gate of the second TFT T2 receives a second scanning signal Scan2. A drain of the second TFT T2 is electrically connected to the first node a.

A gate of the third TFT T3 receives a first scanning signal Scan1. A source of the third TFT T3 is electrically connected to the second node b.

A gate of the fourth TFT T4 receives a third scanning signal Scan3. A drain of the fourth TFT T4 is electrically connected to the second node b.

A terminal of the first capacitor C1 is electrically connected to the first node a, and another terminal of the first capacitor C1 is electrically connected to the second node b.

A terminal of the second capacitor C2 is electrically connected to the second node b. Another terminal of the second capacitor C2 is electrically connected to a reference voltage terminal VREF. A reference voltage terminal VREF supplies the reference signal Vref at low voltage level.

An anode of the OLED is electrically connected to a drain of the third TFT T3. A cathode of the OLED is electrically connected to a second supply voltage Vss.

The first TFT T1 is a driving TFT.

When the OLED display device is powered off or powered on (or the predetermined time after the OLED display device is powered off or powered on), a source of the second TFT T2 receives a first data signal DATA1, and a source of the fourth TFT T4 receives an initialized signal INT or a voltage sensor 400. The voltage sensor 400 is configured to sense the threshold voltage Vth of the first TFT T1 and a turn-on voltage Voled of the OLED, generate a threshold voltage signal based on the threshold voltage Vth, and generate a turn-on voltage compensating signal based on the turn-on voltage Voled of the OLED. The voltage imposed on the turn-on voltage compensating signal is ΔVoled. The operating process of the voltage sensor 400 is detailed in the following. It is notified that the voltage ΔVoled imposed on the turn-on voltage compensating signal is less than the turn-on voltage Voled.

When the OLED display device operates normally (i.e., from the time when the display device is turned on or the predetermined time after the display device is turned on to the time when the display device is turned off), the source of the second TFT T2 receives the second data signal DATA2 formed by a combination of the threshold voltage signal, the raw data signal, and the turn-on voltage compensating signal.

In this embodiment, the initialized signal INT and the first data signal DATA1 are both at constantly low voltage level. Besides, the raw data signal is at single-pulse high voltage level.

Specifically, the first TFT T1, the second TFT T2, the third TFT T3, and the fourth TFT T4 are all low-temperature polycrystalline silicon (LTPS) TFTs, oxide semiconductor TFTs, or amorphous silicon (a-Si) TFTs.

The first scanning signal Scan1, the second scanning signal Scan2, the third scanning signal Scan3, the initialized signal TNI, the first data signal DATA1, and the raw data signal are all generated through an external timing controller (not illustrated).

Figure 4:
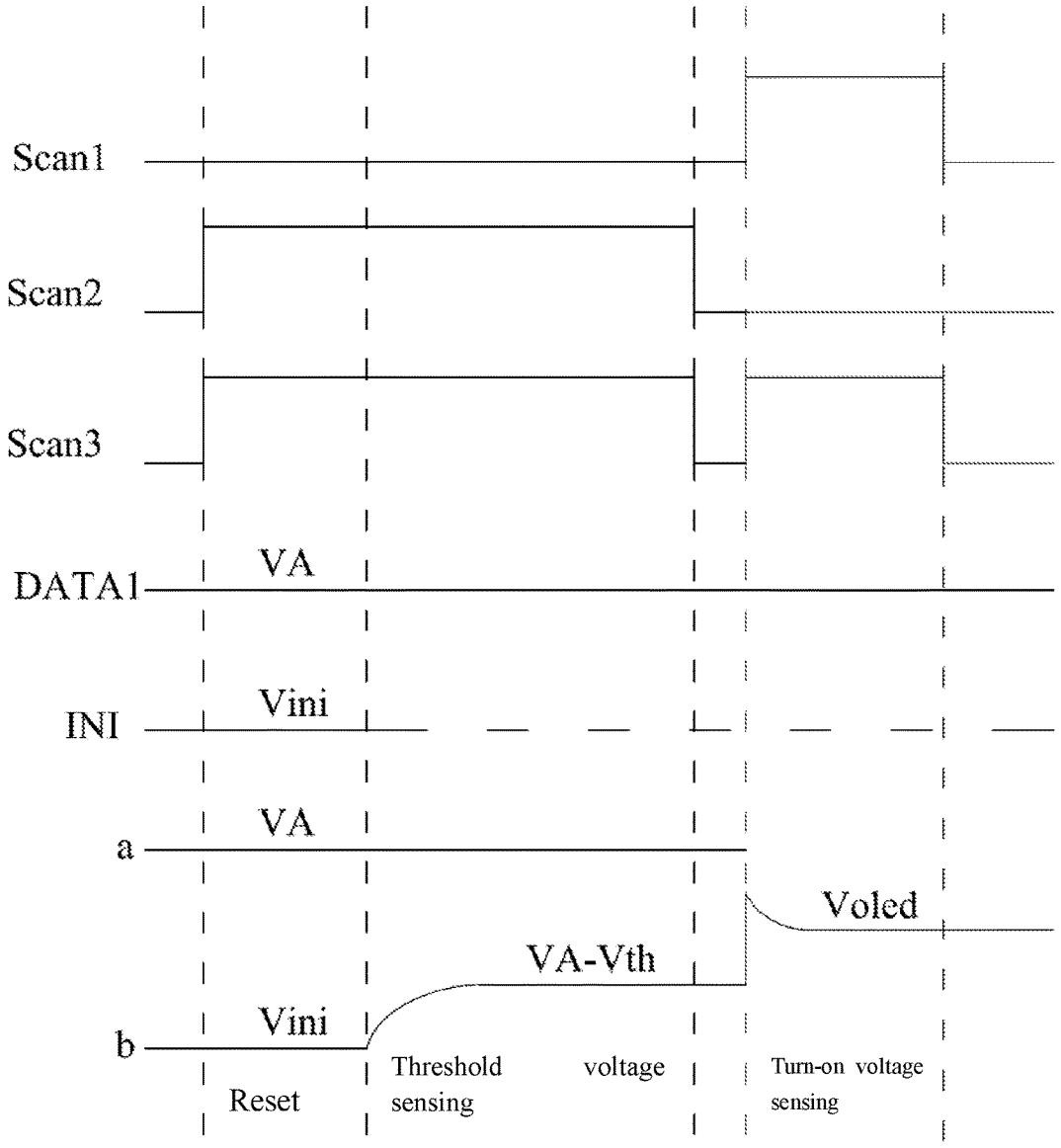
FIG. 4 is a timing diagram of each of the operating stages of the pixel driving circuit when being turned off or on according to the embodiment of the present disclosure.
Figure 5A:
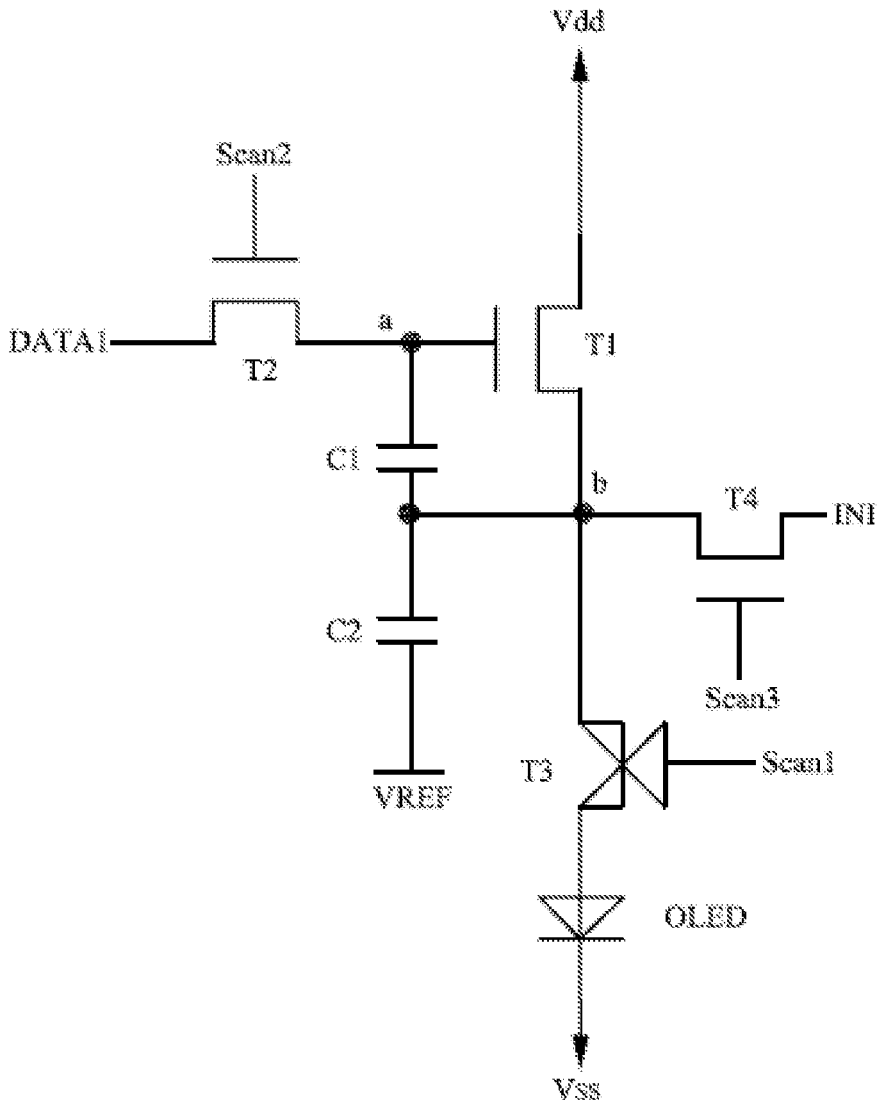
FIGS. 5A to FIG. 5C are operating flowcharts of the pixel driving circuit when being turned off or on according to the embodiment of the present disclosure.
Figure 5B:
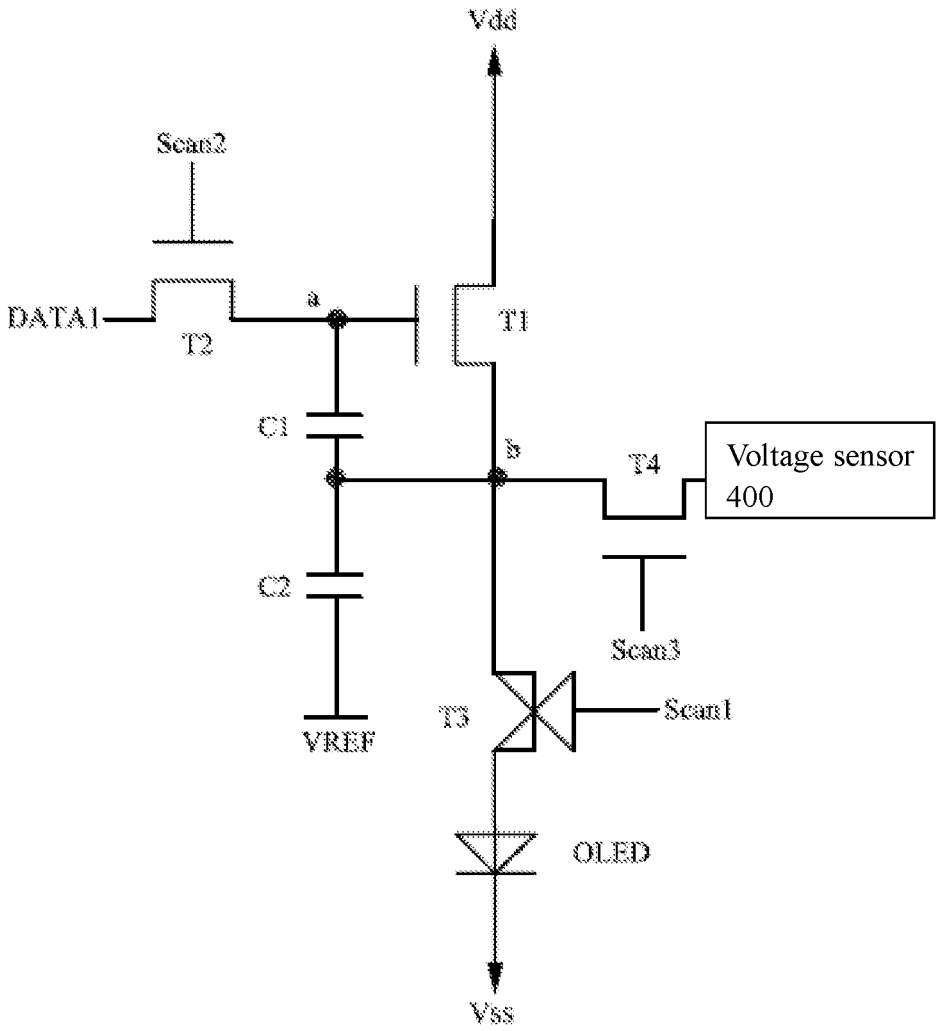
Figure 5C:
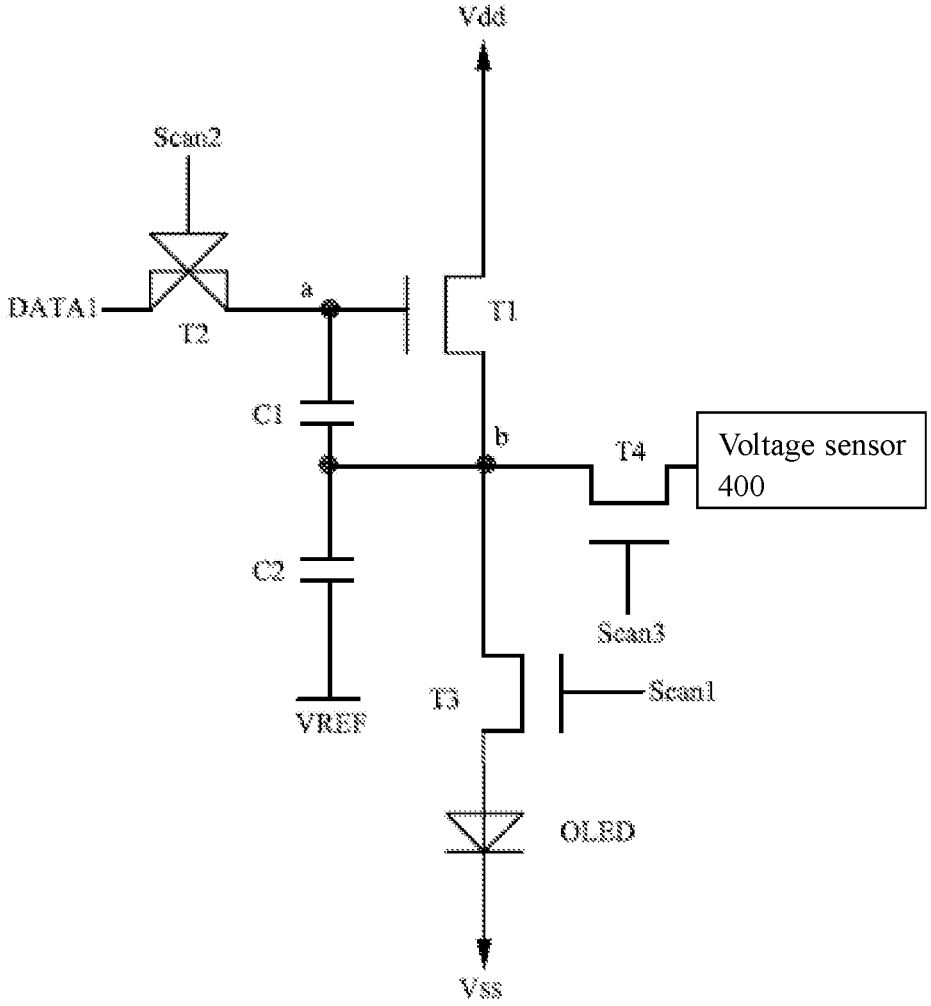

The operating principle of the pixel driving circuit when the OLED display device is powered off or powered on proposed by the present embodiment of the disclosure is elaborated as follows. The pixel with the 4T2C structure performs a reset operation (i.e., reset stage), a threshold voltage sensing operation (i.e., threshold voltage sensing stage), and a turn-on voltage sensing operation (i.e., turn-on voltage sensing stage) when the OLED display device is powered off or powered on. FIG. 4 is a timing diagram of each of the operating stages of the pixel driving circuit when being turned off or on according to the embodiment of the present disclosure. FIG. 5A to FIG. 5C are a set of operating flowchart of the pixel driving circuit when being turned off or on according to the embodiment of the present disclosure. The cross symbol (x) on the TFT, as FIG. 5A to FIG. 5C illustrate, means that the TFT stays turned off.

In the reset stage, as FIG. 4 and FIG. 5A illustrate, the first scanning signal Scanl is at low voltage level. The second scanning signal Scan2 and the third scanning signal Scan3 are both at high voltage level. The first data signal DATA1 is at low voltage level VA. The source of the fourth TFT T4 receives the initialized signal INI. The initialized signal INI is at low voltage level Vini. At this time, the third TFT T3 is turned off. The second TFT T2 and the fourth TFT T4 are both turned on. The voltage imposed on the first node a is Va=V and the voltage imposed on the second b node is Vb=Vini, resulting in Vini=VA, which completes initialization.

At the threshold voltage sensing stage, as FIG. 4 and FIG. 5B illustrate, the first scanning signal Scanl is at low voltage level; the second scanning signal Scan2 and the third scanning signal Scan3 are both at high voltage level; the first data signal DATA1 is at low voltage level VA; the source of the fourth TFT T4 receives the voltage sensor 400. At this time, the third TFT T3 is turned off, and the second TFT T2 and the fourth TFT T4 are both turned on. The voltage imposed on the first node a is Va=VA and the voltage imposed on the second node b is Vb=VA−Vth, so the voltage sensed with the voltage sensor 400 is VA−Vth where Vth is the threshold voltage imposed on the first TFT T1. Further, the threshold voltage Vth is obtained after the voltage sensor 400 calculates internally. For example, the threshold voltage is the deduction of the voltage VA and the sensed voltage. Afterwards, the voltage sensor 400 feedbacks the obtained threshold voltage Vth to the raw data signal, which will be detailed in the following.

At the turn-on sensing stage, as FIG. 4 and FIG. 5C illustrate, the second scanning signal Scan2 is at low voltage level. The first scanning signal Scan1 and the third scanning signal Scan3 are both at high voltage level. The source of the fourth TFT T4 receives the voltage sensor 400. At this time, the second TFT T2 is turned off. The third TFT T3 and the fourth TFT T4 are both turned on. The OLED emits light. The voltage imposed on the second b node is Vb=Voled. Voled is the turn-on voltage of the OLED and is sensed by the voltage sensor 400. Further, the voltage ΔVoled imposed on the turn-on voltage compensating signal is obtained after the voltage sensor 400 calculates internally. For example, the sensed voltage Voled deducts the voltage Vref imposed on the reference signal and the threshold voltage Vth. Or, the sensed voltage Voled deducts the turn-on voltage of the OLED, which is obtained when the OLED display device operates normally and initializes (i.e., the voltage imposed on the second node b, which is obtained at the reset stage as mentioned below).

Figure 6:
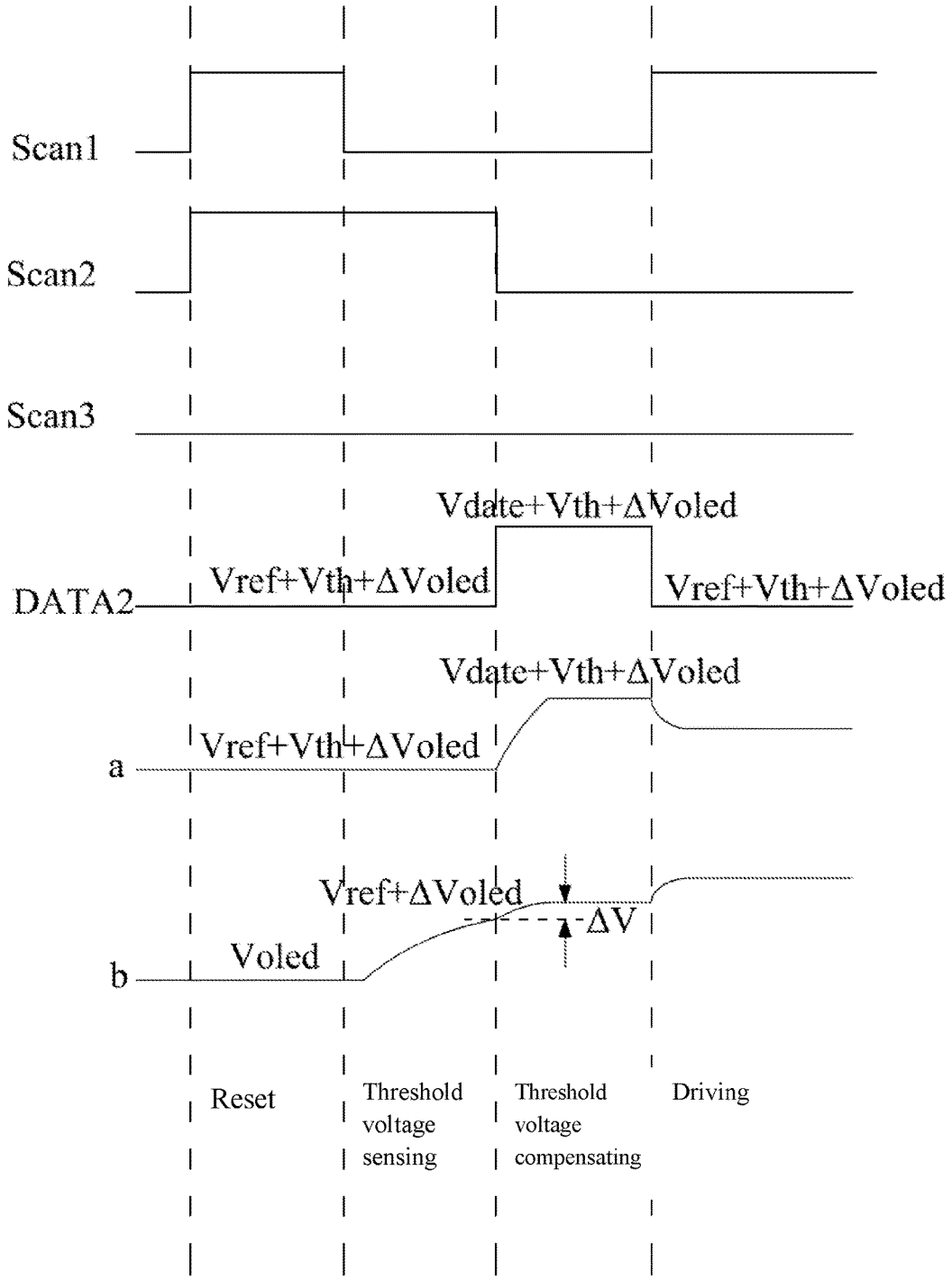
FIG. 6 is a timing diagram of each of the operating stages of the pixel driving circuit in normal display according to the embodiment of the present disclosure.

The operating principle of the pixel driving circuit in normal display proposed by the present embodiment of the disclosure is elaborated as follows. The pixel driving circuit with the 4T2C pixel structure performs a reset operation (i.e., reset stage), a threshold voltage sensing operation (i.e., threshold voltage sensing stage), a threshold voltage compensating operation (i.e., threshold voltage compensating stage), and a driving operation (i.e., driving emitting stage) in normal display. FIG. 6 is a timing diagram of each of the operating stages of the pixel driving circuit in normal display according to the embodiment of the present disclosure. FIG. 7A to FIG. 7D are a set of operating flowchart of the pixel driving circuit in normal display according to the embodiment of the present disclosure. The cross symbol (×) on the TFT, as FIG. 7A to FIG. 7D illustrate, means that the TFT stays turned off.

Figure 7A:
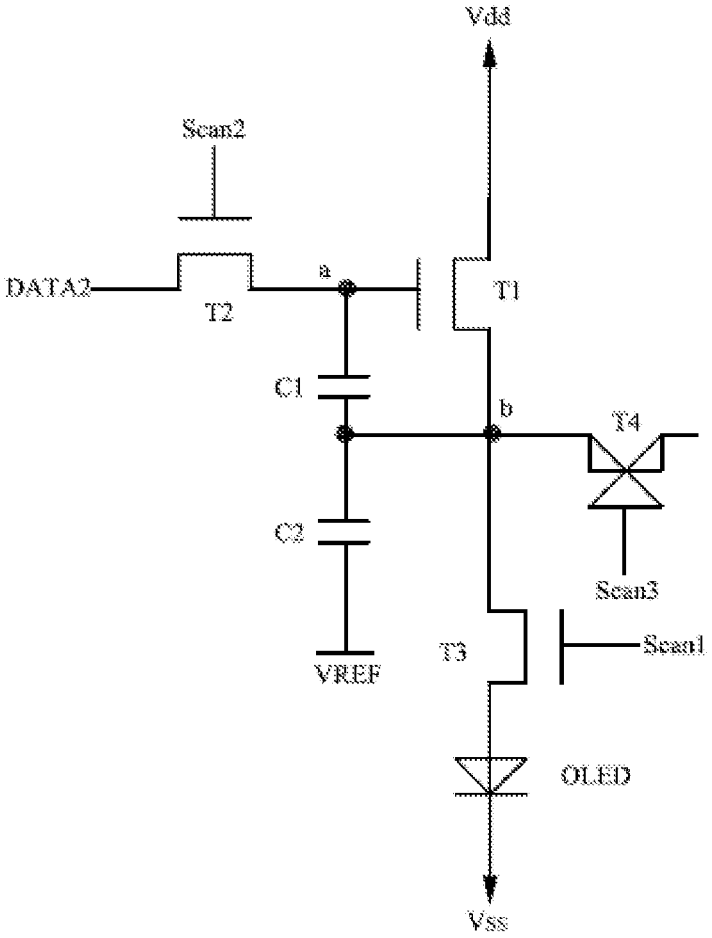
FIGS. 7A to FIG. 7D are operating flowcharts of the pixel driving circuit in normal display according to the embodiment of the present disclosure.

At the reset stage, as FIG. 6 and FIG. 7A illustrate, the first scanning signal Scan1 and the second scanning signal Scan2 are both at high voltage level; the third scanning signal Scan3 is at low voltage level; the second data signal DATA2 is the sum of the reference signal Vref at low voltage level, the turn-on voltage compensating signal which the voltage ΔVoled is imposed on, and the threshold voltage signal which the voltage Vth is imposed on. At this time, the fourth TFT T4 is turned off; the second TFT T2 and the third TFT T3 are both turned on; the second data signal DATA2 is written to the first node a (i.e., the gate of the first TFT T1) through the second TFT T2; the voltage Vb imposed on the second node b is the turn-on voltage Voled imposed on the OLED; the OLED emits light.

At the reset stage, $$Vg=Va=V\text{ref}+Vth+\Delta Voled$$

$$Vs=Vb=Voled$$

Vg indicates the gate voltage level of the first TFT T1. Va indicates the voltage level of the first node a. Vs indicates the source voltage level of the first TFT T1. Vb indicates the voltage level of the second node b. Voled indicates the turn-on voltage imposed on the OLED. Vth indicates the threshold voltage imposed on the first TFT T1. ΔVoled indicates the voltage imposed on the turn-on voltage compensating voltage.

Figure 7B:
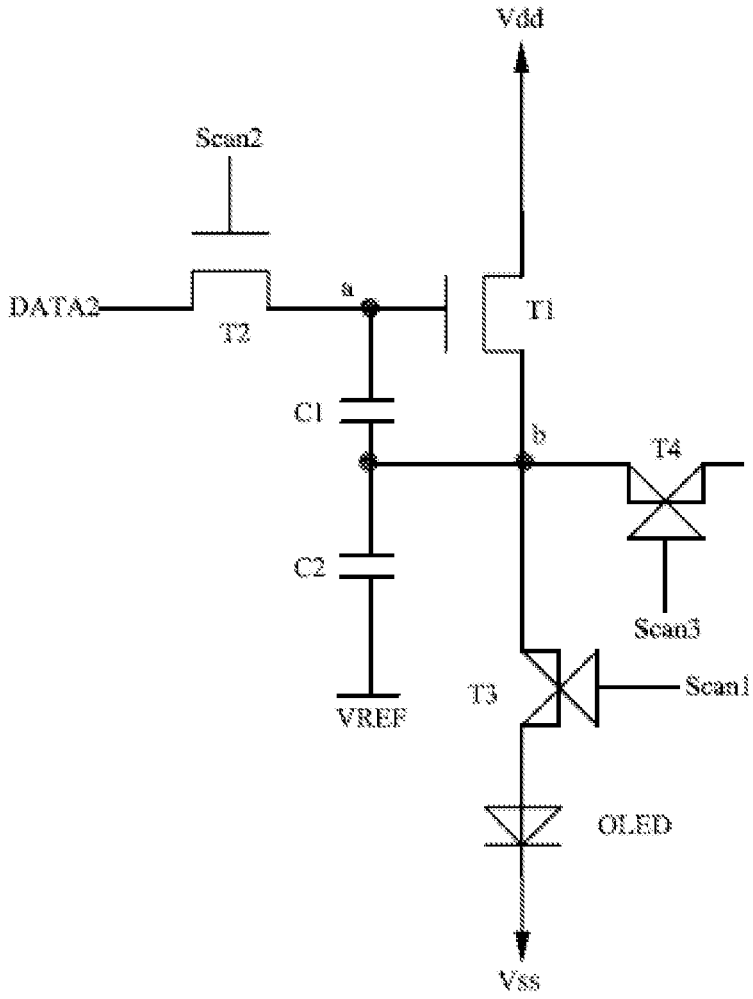

At the threshold voltage sensing stage, as FIG. 6 and FIG. 7B illustrate, the first scanning signal Scanl and the third scanning signal Scan3 are both at low voltage level; the second scanning signal Scan2 is at high voltage level; the second data signal DATA2 is the sum of the reference signal Vref at low voltage level, the turn-on voltage compensating signal which the voltage ΔVoled is imposed on, and the threshold voltage signal which the voltage Vth is imposed on. At this time, the second TFT T2 is turned on; the third TFT T3 and the fourth TFT T4 are both turned off; the first node a (i.e., the gate of the first TFT T1) is still written to the second data signal DATA2; the voltage level of the second node b (i.e., the source of the first TFT T1) is turned into Vref+ΔVoled.

At the threshold voltage sensing stage, $$Vg=Va=V\text{ref}+Vth+\Delta Voled$$

$$Vs=Vb=V\text{ref}+\Delta Voled$$

Figure 7C:
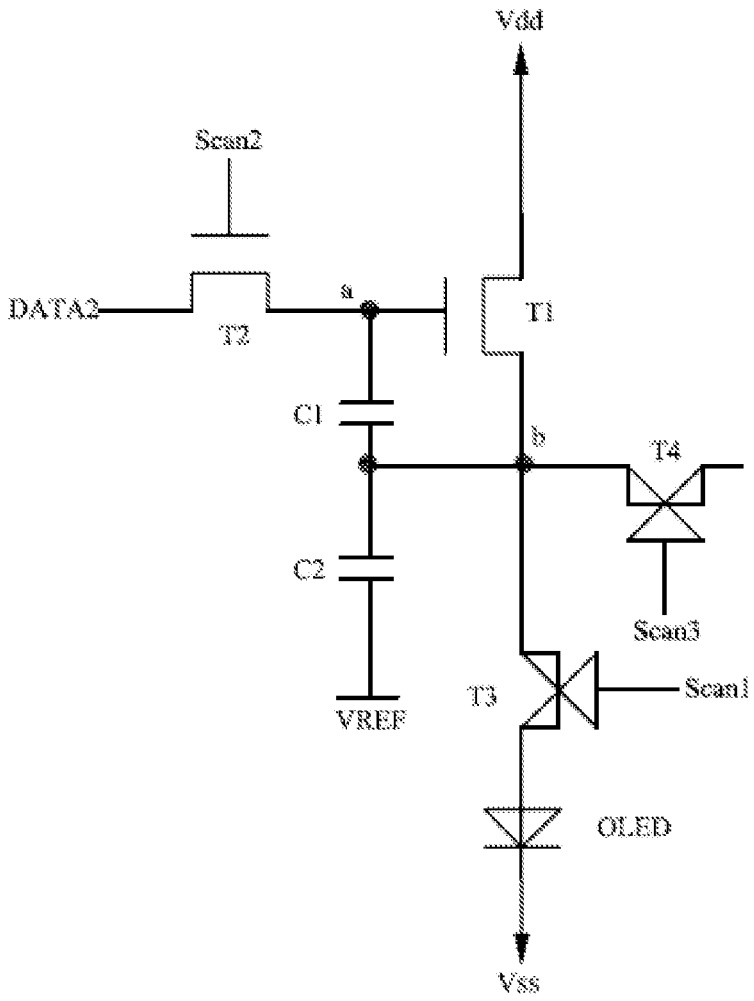

At the threshold voltage compensating stage, as FIG. 6 and FIG. 7C illustrates, the first scanning signal Scan1 and the third scanning signal Scan3 are both at low voltage level. The second scanning signal Scan2 is at high voltage level. The second data signal DATA2 is the sum of the reference signal Vref at high voltage level, the turn-on voltage compensating signal which the voltage ΔVoled is imposed on, and the threshold voltage signal which the voltage Vth is imposed on. At this time, the third TFT T3 and the fourth TFT T4 are both turned off; the second TFT T2 is turned on. The second data signal DATA2 is written to the first node a (i.e., the gate of the first TFT T1) through the second TFT T2. The voltage level of the second node b (i.e., the source of the first TFT T1) is turned into Vref+ΔVoled+ΔV. ΔV represents the influence of the display data signal Vdata at high level on the voltage level of the source of the first TFT T1 (i.e., the second node b). So the influence is irrelevant to the threshold voltage Vth of the first TFT T1.

At the threshold voltage compensating stage, $$Vg=Va=V\text{data}+Vth+\Delta Voled$$

$$Vs=Vb=V\text{ref}+\Delta V+\Delta Voled$$

In this way, the difference Vgs between the gate voltage Vg imposed on the first TFT T1 and the source voltage Vs imposed on the first TFT T1 is $$Vgs=Vg-Vs=V\text{data}+Vth-V\text{ref}-\Delta V$$

Figure 7D:
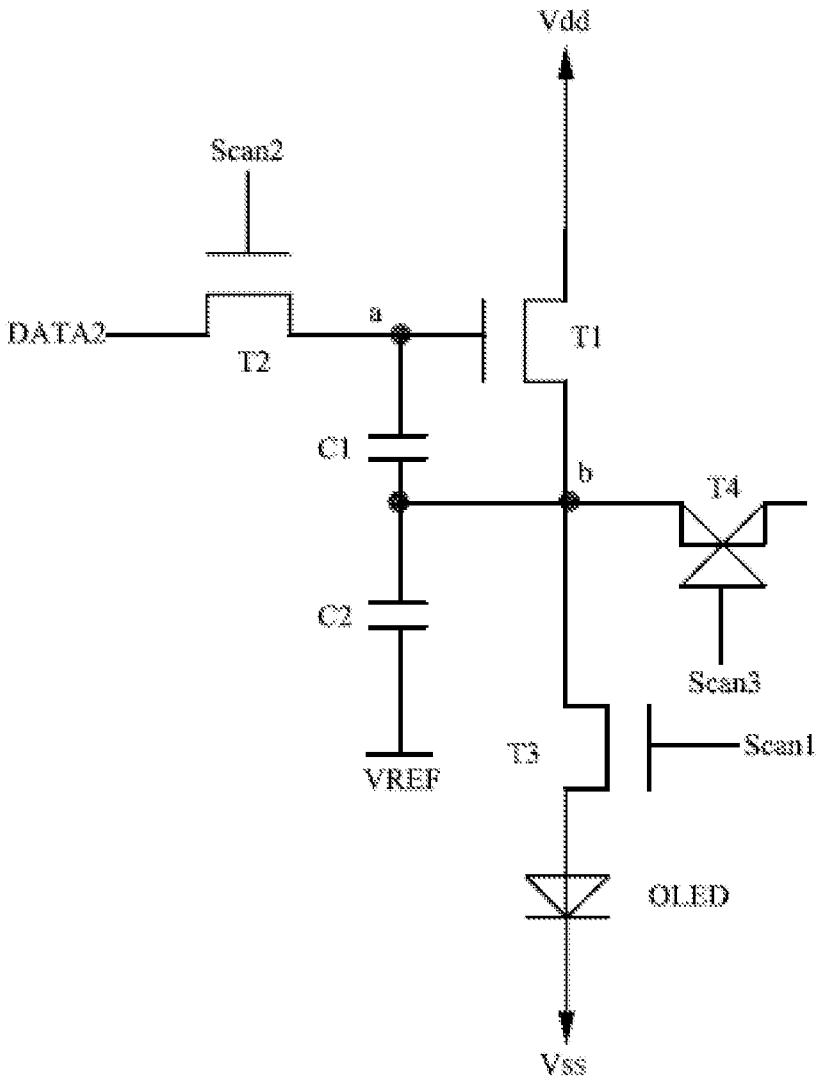

At the driving emitting stage, as FIG. 6 and FIG. 7D illustrate, the first scanning signal Scan1 is at high voltage level; the second scanning signal Scan2 and the third scanning signal Scan3 are both at low voltage level; the second data signal DATA2 is the sum of the reference signal Vref at low voltage level, the turn-on voltage compensating signal which the voltage ΔVoled is imposed on, and the threshold voltage signal which the voltage Vth is imposed on. At this time, the second TFT T2 and the third TFT T3 are both turned on; the fourth TFT T4 is turned off; the difference Vgs between the first node a (i.e., the voltage level of the gate of the first TFT T1) and the second node b (i.e., the voltage level of the source of the first TFT T1) maintains the same.

Further, the current I flowing the OLED is $$I=K(Vgs-Vth)^2=K(V\text{data}-V\text{ref}-\Delta V+Vth-Vth)^2=K(V\text{data}-V\text{ref}-\Delta V)^2,$$

where K indicates an intrinsic conducting factor of the first TFT T1. The intrinsic conducting factor is determined by the characteristics of the first TFT T1.

As the equation of the current I flowing the OLED shows, the current I is irrelevant to the threshold voltage Vth of the first TFT T1. In other words, the phenomenon of poor image display due to the drift of the threshold voltage Vth of the first TFT T1 is completely cleared.

Above are embodiments of the present invention, which does not limit the scope of the present invention. Any modifications, equivalent replacements or improvements within the spirit and principles of the embodiment described above should be covered by the protected scope of the invention.

What is claimed is:

1. A pixel driving circuit for an organic light-emitting diode (OLED) display device, comprising:

a first thin-film transistor (TFT), comprising a gate electrically connected to a first node, a source electrically connected to a second node, and a drain electrically connected to a first supply voltage;

a second TFT, comprising a gate receiving a second scanning signal and a drain electrically connected to the first node;

a third TFT, comprising a gate receiving a first scanning signal and a source electrically connected to the second node;

a fourth TFT, comprising a gate receiving a third scanning signal and a drain electrically connected to the second node;

a first capacitor, electrically connected between the first node and the second node;

a second capacitor, electrically connected between the second node and a reference signal at low voltage level;

an OLED, comprising an anode electrically connected to a drain of the third TFT and a cathode electrically connected to a second supply voltage;

wherein when the OLED display device is powered off or powered on, a source of the second TFT receives the first data signal, a source of the fourth TFT receives an initialized signal or a voltage sensor, and the voltage sensor is configured to sense a threshold voltage of the first TFT and a turn-on voltage of the OLED and generate a threshold voltage signal and a turn-on voltage compensating signal;

when the OLED display device operates normally, the source of the second TFT receives the second data signal formed by a combination of the threshold voltage signal, the turn-on voltage compensating signal, and a raw data signal;

wherein the initialized signal and the first data signal are both at constantly low voltage level, the raw data signal is at single-pulse high voltage level.

2. The pixel driving circuit of claim 1, wherein the pixel driving circuit performs a reset operation, a threshold voltage sensing operation, and a turn-on voltage sensing operation when the OLED display device is powered off or powered on.

3. The OLED display device of claim 2, wherein when the pixel circuit performs the reset operation, the first scanning signal is at low voltage level, the second scanning signal and the third scanning signal are both at high voltage level, the source of the fourth TFT receives the initialized signal.

4. The pixel driving circuit of claim 3, wherein when the pixel circuit performs the threshold voltage sensing operation, the first scanning signal is at low voltage level, the second scanning signal and the third scanning signal are both at high voltage level, and the source of the fourth TFT receives the voltage sensor.

5. The pixel driving circuit of claim 3, wherein when the pixel circuit performs the turn-on voltage sensing operation, the first scanning signal and the third scanning signal are both are high voltage level, the second scanning signal is at low voltage level; the source of the fourth TFT receives the voltage sensor.

6. The pixel driving circuit of claim 1, wherein the pixel driving circuit performs the reset operation, a threshold voltage sensing operation, a threshold voltage compensating operation, and a driving operation when the OLED display device is in normal display.

7. The OLED display device of claim 6, wherein when the pixel circuit performs the reset operation, the first scanning signal and the second scanning signal are at high voltage level, the third scanning signal is at low voltage level, and the second data signal is a sum of the reference signal at low voltage level, the threshold voltage signal and the turn-on voltage compensating signal.

8. The pixel driving circuit of claim 7, wherein when the pixel circuit performs the threshold voltage sensing operation, the first scanning signal and the third scanning signal are at low voltage level, the second scanning signal is at high voltage level, and the second data signal is a sum of the reference signal at low voltage level, the threshold voltage signal and the turn-on voltage compensating signal.

9. The pixel driving circuit of claim 8, wherein when the pixel circuit performs the threshold voltage compensating operation, the first scanning signal and the third scanning signal are both are low voltage level, the second scanning signal is at high voltage level, and the second data signal is a sum of the reference signal at high voltage level, the threshold voltage signal and the turn-on voltage compensating signal.

10. The pixel driving circuit of claim 9, wherein when the pixel driving circuit performs the driving operation, the first scanning signal is at high voltage level, the second scanning signal and third scanning voltage are at high voltage level, and the second data signal is the sum of the reference signal at low voltage level, the threshold voltage signal and the turn-on voltage compensating signal.

11. An organic light-emitting diode (OLED) display device comprising the pixel driving circuit as claimed claim 1.

* * * * *